United States Patent [19]

Achia et al.

[11] 4,203,824

[45] May 20, 1980

[54] POLYVINYLPYRROLIDONE DEWAXING AID FOR BRIGHT STOCKS

[75] Inventors: Biddanda U. Achia, Sarnia; David H. Shaw, Camlachie, both of Canada

[73] Assignee: Exxon Research & Engineering Co., Florham Park, N.J.

[21] Appl. No.: 972,230

[22] Filed: Dec. 22, 1978

[51] Int. Cl.[2] ..... C10G 43/06; C10G 43/08

[52] U.S. Cl. ..... 208/33; 208/38

[58] Field of Search ..... 208/28, 33, 38; 252/51.5 A

[56] References Cited

U.S. PATENT DOCUMENTS 3,239,445 3/1966 Leonard et al. ..... 208/33

FOREIGN PATENT DOCUMENTS 808665 2/1959 United Kingdom ..... 252/51.5 A

*Primary Examiner*—Herbert Levine

*Attorney, Agent, or Firm*—Edward M. Corcoran

[57] ABSTRACT

Polyvinylpyrrolidone having a number average molecular weight ranging from about 150,000 to 400,000 has been found to be an effective dewaxing aid for bright stock in ketone dewaxing processes. Using as little as 100 ppm based on the waxy oil can result in almost a 50% increase in the filter rate of the dewaxed oils from the wax.

11 Claims, No Drawings

POLYVINYLPYRROLIDONE DEWAXING AID FOR BRIGHT STOCKS

BACKGROUND OF THE INVENTION

1. Field of the Invention

This invention relates to a process for solvent dewaxing waxy hydrocarbon oils using a dewaxing aid. More particularly, this invention relates to a solvent dewaxing process for waxy hydrocarbon oils using a polyvinylpyrrolidone dewaxing aid. Still more particularly this invention relates to a ketone solvent dewaxing process for bright stocks employing a polyvinylpyrrolidone dewaxing aid having a number average molecular weight ranging from about 40,000 to 400,000.

2. Description of the Prior Art

Waxes in wax-containing hydrocarbon oils are removed therefrom by chilling the oil to precipitate out the wax and then separating the solid wax particles from the dewaxed oil by filtration or centrifugation. Industrial dewaxing processes include press dewaxing processes wherein the wax-containing oil, in the absence of solvent, is chilled to crystallize out the wax particles which are then pressed out by a filter. In general, only light hydrocarbon oil fractions (paraffinic fractions) obtained by vacuum distillation are treated by press dewaxing processes due to viscosity limitations. More widely used are solvent dewaxing processes wherein a waxy oil is mixed with a solvent and then chilled to precipitate the wax as tiny particles or crystals thereby forming a slurry comprising wax particles and a solution of dewaxed oil containing dewaxing solvent. The slurry is then fed to a wax filter wherein the wax is removed from the dewaxed oil and dewaxing solvent. Solvent dewaxing processes are used for heavier oil fractions such as lubricating oil fractions and bright stocks. Typical dewaxing solvents include ketones such as mixtures of acetone and MEK or MEK and MIBK as well as mixtures of ketones and aromatic hydrocarbons such as MEK/toluene and acetone/benzene.

One of the factors tending to limit the capacity of a solvent dewaxing plant is the rate of wax filtration from the dewaxed oil, which in turn is strongly influenced by the crystal structure of the precipitated wax. Although the crystal structure of the precipitated wax is influenced by various operating conditions in the dewaxing process, for any given feed it is most strongly influenced by the chilling condition. The size and crystal structure of the precipitated wax, occlusion of oil in the wax crystals and of the condition of the oil left in the crystal are extremely varied and depend on the wax composition and precipitation condition. These conditions also affect the filtration rate of the dewaxed oil from the wax and the yield of dewaxed oil. In some cases, most notably when the waxy oil is a bright stock, the wax crystals are of an extremely fine size and not all are separated by filtration, but some leave the filter with the dewaxed oil component which creates an objectionable haze in the oil.

One way of increasing the filtration rate and minimize haze formation is to add a dewaxing aid to the wax-containing oil. Well known in the art are dewaxing aids such as α-olefin copolymers, mixtures of materials such as a mixture of (a) an ethylene-vinyl acetate copolymer and (b) an unsaturated ester of an aliphatic alcohol having from 2 to 20 carbon atoms with acrylic or methacrylic acid, as well as polymeric dewaxing aids comprising condensation products of chlorinated paraffins and naphthalenes alone or mixed with acrylic ester polymers. However, in the case of heavy stocks, these dewaxing aids are not too efficient, therefore necessitating relatively high concentrations of the dewaxing aid in the oil. This is especially true when a heavy oil raffinate or a bright stock is solvent dewaxed. When these oils are solvent dewaxed, a portion of the wax is precipitated as crystals so fine that they pass through filter cloths thereby creating a haze in the dewaxed oil which greatly reduces the commercial value of same. Also, because of the presence of so many fine particles of wax, the filter rate of the dewaxed oil tends to be lower than that obtained with lighter lube oil stocks. Therefore, there is a need for efficient dewaxing aids for use with heavy stocks.

SUMMARY OF THE INVENTION

It has now been found that polyvinylpyrrolidone (PVP) is an effective dewaxing aid for wax-containing hydrocarbon oils when used in ketone solvent dewaxing processes. The PVP should have a relatively high number average molecular weight ranging from about 40,000 to 400,000 and more preferably from about 160,000 to 360,000. PVP is commercially available from the General Aniline and Film Corporation and has the following chemical structure:

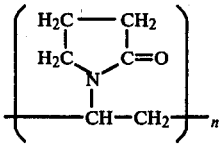

PVP has been found to be effective when used in an amount ranging from about 5 to 2500 ppm, more preferably from 25 to 500 ppm and still more preferably from about 50 to 150 ppm of the waxy oil to be dewaxed. This invention has been found to be particularly effective when used in ketone dewaxing heavier hydrocarbon oils such as deasphalted residua or bright stocks.

By ketone dewaxing is means any solvent dewaxing process employing one or more ketones as the dewaxing solvent and includes mixtures of ketone and non-ketone solvents. Suitable ketones include ketones having from 3 to 8 carbon atoms such as acetone, methylethyl ketone (MEK), diethyl ketone, methylpropyl ketone, methylisobutyl ketone (MIBK), methylcyclohexyl ketone and mixtures thereof as well as mixtures of the aforesaid ketones with one or more aromatic solvents including toluene, xylene, benzene and naphtha and mixtures of the aforesaid with one or more 3 to 10 carbon atom alkanes and olefins. Of course, it is to be understood that the PVP dewaxing aid should be soluble in the dewaxing solvent and, in any event, must be soluble in the oil/solvent mixture. In some cases, it has been found to be necessary to predissolve the PVP in an alcohol, such as isobutanol, which also serves as a cosolvent to maintain the PVP in solution in certain dewaxing solvents such as mixtures of MEK/toluene. PVP has been found to be ineffective as a dewaxing aid when used in dewaxing processes employing only alkane hydrocarbons, such as propane in a propane auto-refrigerant dewaxing process.

Any heavy waxy petroleum oil stock or distillate fraction thereof may be dewaxed employing the dewaxing aid of this invention. Illustrative, but non-limiting examples of such stocks are (a) distillate fractions that have an initial boiling point above about 800° F., with preferred stocks including heavy lubricating oil and specialty oil fractions boiling within the range of from between about 800° and 1200° F., and (b) bright stocks or deasphalted resids having an initial boiling point above about 800° F. Included in the above are synthetic lube oil fractions derived from tar sands, coal, etc. Additionally, any of these feeds may be hydrocracked prior to distilling or deasphalting. They may come from any source such as the paraffinic crudes obtained from Aramco, Kuwait, the Panhandle, North Louisiana, etc. Naphthenic crudes such as Tia Juana, Coastal Crudes, etc., as well as the relatively heavy feedstocks and synthetic feedstocks derived from Athabasca tar sands, coal, Cold Lake crude, etc. As hereinbefore stated, this invention is particularly suited for dewaxing bright stocks or deasphalted resids. Finally, although not necessary, it is preferred to dissolve the dewaxing aid in the dewaxing solvent so that it is added to the waxy oil in solution in said dewaxing solvent.

DESCRIPTION OF A PREFERRED EMBODIMENT

Although any ketone solvent dewaxing process may be employed using this invention, in a preferred embodiment the waxy oil will be ketone solvent dewaxed using a DILCHILL® (registered service mark of Exxon Research and Engineering Company) dewaxing process, the basic concept of which is shown in U.S. Pat. No. 3,773,650, the disclosures of which are incorporated herein by reference. Thus, the waxy oil is introduced into the top of an elongated, staged cooling tower at a temperature above its cloud point and the cold dewaxing solvent is incrementally introduced into said zone along a plurality of stages therein while a high degree of agitation is maintained in stages of said tower so as to achieve substantially instantaneous mixing of the solvent and wax/oil mixture as they progress through said zone. Thus, one volume of a paraffinic bright stock oil, having a viscosity of 2500 SUS at a temperature of about 100° F., is prediluted with 1 volume of solvent comprising a mixture of 55 volumes of MEK to 45 volumes of toluene, with the prediluted oil then introduced, at a temperature above its cloud point (about 130° F.), into the top of a 16-stage DILCHILL tower. The PVP dewaxing aid having a number average molecular weight of about 360,000 is added to the oil dissolved in the predilution solvent, in an amount required to provide 100 ppm of dewaxing aid based on the waxy oil. Cold dewaxing solvent, at a temperature of −20° F., comprising a mixture of 55 volumes of MEK to 45 volumes of toluene and containing the PVP dewaxing aid is introduced into the stages of said tower wherein the dewaxing aid-containing solvent is substantially instantaneously mixed with the waxy oil, thereby forming a slurry comprising solid particles of wax and a dewaxed oil solution. About 3 volumes of solvent per volume of waxy oil feed are added to and mixed with the oil in the tower to produce a slurry exiting the tower at a temperature of about 40° F. The waxy slurry leaves the tower at a temperature of about 40° F., is then passed through a scraped surface chiller wherein it is further cooled down to a wax filtration temperature of about 0° F. and from there passed through a rotary drum vacuum filter to separate the solid particles of wax from the dewaxed oil solution.

The invention will be more apparent from the following example.

EXAMPLE

Polyvinylpyrrolidone having a number average molecular weight of 360,000 and obtained from GAF as PVP K-90 was dissolved in the dewaxing solvent (55/45 volumes per volume of MEK/toluene) by first preparing a 25% PVP solution in isobutanol.

DILCHILL dewaxing with the MEK/toluene solvent was simulated in a laboratory single-stage crystallizer equipped with a suitable agitating device. An Arabian Light deasphalted and extracted residual oil (bright stock) having a viscosity of 2500 SUS at 100° F. was prediluted with the PVP-containing MEK/toluene dewaxing solvent in an amount of one volume of solvent per volume of waxy feed. This mixture, at its cloud point (130° F.), was introduced into the DILCHILL crystallizer, wherein the mixture was further chilled, in stages, by the injection of about 3 volumes of cold PVP-containing solvent per volume of waxy oil feed. The slurry left the DILCHILL crystallizer at about 40° F. and was further cooled to a wax filtration temperature of 0° F. by scraped surface chilling in a dashpot apparatus.

The slurry was evaluated for its filtration performance using a leaf filtration apparatus. The data in the table illustrates the improved slurry filtration performance with the use of the PVP dewaxing aid. The data show that the use of only 100 ppm of PVP dewaxing aid gave a 43% increase in filter rate.

TABLE

| Run No. | 1539 | 1568 |
|---|---|---|
| PVP, ppm | 0 | 100 |
| Agitator Tip Speed[1], cm/s | ←200→ | |
| Dilution to Filter, v/v | 3.8 | 3.8 |
| Feed Filter Rate, $m^3/m^2$ day | 3.4 | 4.85 |
| Cake Liquids/Solids, w/w | 3.6 | 3.9 |

[1]5 cm dia 6-flat blade disc turbine

What is claimed is:

1. A solvent dewaxing process comprising mixing a waxy hydrocarbon oil with a polyvinylpyrrolidone dewaxing aid and a ketone dewaxing solvent and chilling said mixture to form a slurry comprising solid particles of wax and a solution of dewaxed oil and ketone dewaxing solvent and separating said wax from said dewaxed oil solution.

2. The process of claim 1 wherein said dewaxing aid is used in an amount ranging from about 5 to 2500 ppm of said waxy oil.

3. The process of claim 1 wherein the number average molecular weight of said dewaxing aid ranges from about 40,000 to 400,000.

4. The process of claim 3 wherein said ketone dewaxing solvent comprises at least one solvent selected from the group consisting essentially of from three to eight carbon atom ketone solvents.

5. A solvent dewaxing process comprising chilling a mixture of a waxy petroleum oil fraction feed, polyvinylpyrrolidone, and at least one ketone solvent having from three to eight carbon atoms, to form a slurry comprising solid particles of wax and a solution of dewaxed oil and solvent and separating said wax from said slurry.

6. The process of claim 5 wherein said polyvinylpyrrolidone is present in an amount ranging from about 5 to 2500 ppm of said waxy feed and has a number average molecular weight of from about 40,000 to 400,000.

7. The process of claim 1 wherein said feed is a natural or synthetic lube oil fraction.

8. The process of claim 6 wherein said polyvinylpyrrolidone is present in an amount of from 25 to 500 ppm and has a number average molecular weight ranging from between about 160,000 to 360,000.

9. A process for solvent dewaxing a bright stock comprising mixing said bright stock with at least one three to eight carbon atom ketone solvent and polyvinylpyrrolidone and chilling said mixture to form a slurry comprising solid particles of wax and a solution of dewaxed oil and solvent, and separating said wax from said solution.

10. The process of claim 9 wherein said polyvinylpyrrolidone has a number average molecular weight of from about 40,000 to 400,000 and is present in an amount ranging from about 5 to 2500 ppm of said stock.

11. The process of claim 10 wherein said molecular weight ranges from about 160,000 to 360,000 and is used in an amount ranging from about 25 to 500 ppm.

* * * * *